US006628051B1

(12) United States Patent
Menken et al.

(10) Patent No.: US 6,628,051 B1
(45) Date of Patent: Sep. 30, 2003

(54) SPARK PLUG FOR AN INTERNAL COMBUSTION ENGINE

(75) Inventors: Lars Menken, Donzdorf (DE); Bernd Reinsch, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 57 days.

(21) Appl. No.: 09/806,132

(22) PCT Filed: Jul. 22, 2000

(86) PCT No.: PCT/DE00/02409

§ 371 (c)(1),
(2), (4) Date: May 14, 2001

(87) PCT Pub. No.: WO01/09998

PCT Pub. Date: Feb. 8, 2001

(30) Foreign Application Priority Data

Aug. 19, 1999 (DE) ..... 199 39 319
Jul. 29, 1999 (DE) ..... 199 35 676

(51) Int. Cl.[7] ..... H01T 13/20

(52) U.S. Cl. ..... 313/143; 313/135; 313/136; 313/141; 313/144

(58) Field of Search ..... 123/169 R, 169 EL; 313/135, 136, 137, 141, 142, 143, 144, 145, 118, 326

(56) References Cited

U.S. PATENT DOCUMENTS

| | | | | | |
|---|---|---|---|---|---|
| 3,171,052 | A | * | 2/1965 | Schwartzwalder | 313/145 |
| 3,192,429 | A | * | 6/1965 | Candelise | 313/289 |
| 3,922,396 | A | * | 11/1975 | Speirs et al. | 427/250 |
| 4,406,968 | A | * | 9/1983 | Friese et al. | 313/136 |
| 4,659,960 | A | * | 4/1987 | Toya et al. | 313/141 |
| 5,503,874 | A | * | 4/1996 | Ackerman et al. | 427/237 |
| 5,952,770 | A | | 9/1999 | Mueller | 313/141 |

FOREIGN PATENT DOCUMENTS

| | | |
|---|---|---|
| DE | 44 31 143 | 3/1996 |
| DE | 196 23 989 | 1/1998 |
| WO | WO 97/49153 | 12/1997 |

* cited by examiner

*Primary Examiner*—Nimeshkumar D. Patel
*Assistant Examiner*—Jason Phinney
(74) *Attorney, Agent, or Firm*—Kenyon & Kenyon

(57) ABSTRACT

A spark plug having a ceramic insulator, which contains a precious-metal center electrode in a cylindrical, axial opening, at the end on the side of the combustion chamber. A contact pin is arranged in the cylindrical opening, downstream from the precious-metal center electrode, in the direction of the insulator end away from the combustion chamber. To reduce corrosion, the surface of the contact pin is provided with a layer of one or more metal aluminides.

15 Claims, 3 Drawing Sheets

SPARK PLUG FOR AN INTERNAL COMBUSTION ENGINE

FIELD OF THE INVENTION

The present invention relates to a spark plug for an internal combustion engine.

BACKGROUND INFORMATION

German Patent No. 196 23 989 describes a spark plug where a center electrode is inserted into the insulator at the end on the side of the combustion chamber, into a cylindrical, axial bore hole. A metallic contact pin provided with a layer of nickel or of a nickel-silver alloy is arranged downstream, in the direction of the insulator end away from the combustion chamber. This contact pin is in electrical contact with the center electrode.

SUMMARY OF THE INVENTION

The spark plug according to the present invention has the advantage that the corrosion resistance of the contact pin is effectively improved using a simple solution. Thus, the spark plug's operational reliability is improved. Furthermore, it is ensured that the center electrode is stable in retaining its shape and location, thereby preventing an increase in the required ignition voltage.

Therefore, from a standpoint of production engineering, it is favorable to coat the entire surface of the contact pin. It is also advantageous from a standpoint of production engineering to coat using thermal spraying or deposition from the gas phase, in particular using aluminization, thereby enabling the spark plug according to the present invention to be produced in large quantities. Furthermore, it is advantageous that the coated contact pin be pre-oxidized prior to being installed because this forms an $A1_2O_3$ protective layer. Forming the contact pin from an Fe-Co-Ni alloy is advantageous since the alloy is adjusted to the average coefficient of the insulator's thermal expansion. In addition, it is advantageous for the contact pin to have a cylindrical shape and a larger diameter at the end away from the combustion chamber, in particular to be step-wise or conically offset, since, in this way, the contact pins can be advantageously transported during manufacturing. Manufacturing the spark plug with a simple cylindrical or conical shape is equally advantageous, since the number of manufacturing steps can be decreased.

A tip of the contact pin that tapers in a conical manner on the side of the combustion chamber is advantageous because a higher pressurization of the end of the contact pin on the side of the combustion chamber can be achieved during production.

DETAILED DESCRIPTION

Figure 1:
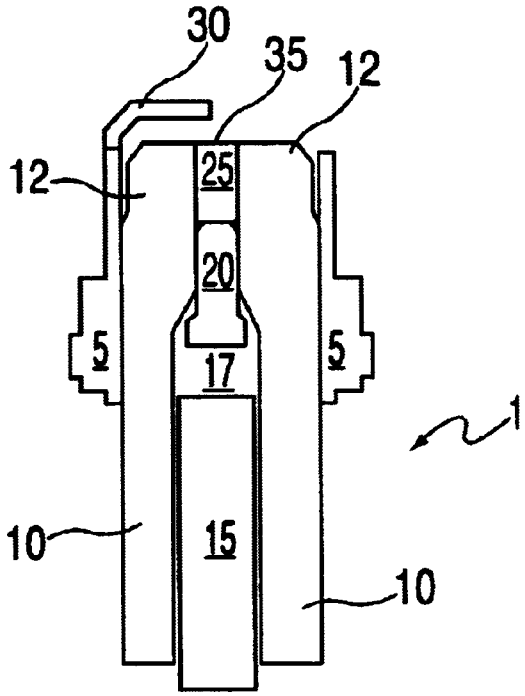
FIG. 1 shows a schematic longitudinal cross section of a spark plug according to the present invention.

FIG. 1 shows a schematic longitudinal cross section of a spark plug 1 according to the present invention. A ceramic insulator 10, whose end on the side of the combustion chamber has a reduced external diameter and forms so-called insulator base 12, is arranged in a metallic, tubular housing 5. The rotational-symmetry axes of spark-plug housing 5 and insulator 10 are coincident. Likewise coincident is the axis of a terminal stud 15 embedded in the cylindrical opening at the end of insulator 10 away from the combustion chamber. One or more panat packets 17, a contact pin 20, and a precious-metal electrode 25 are also arranged, in that sequence, in the cylindrical opening of the insulator, downstream from terminal stud 15, in the direction of the combustion chamber. Precious-metal electrode 25 is typically referred to as a center electrode. The rotational-symmetry axes of center electrode 25 and contact pin 20 are coincident with the axis of insulator base 12. Ground electrode 30, which is offset in the direction of the center electrode, is arranged at the spark-plug housing. The free space between the center electrode and the ground electrode is designated as spark gap 35.

Precious-metal center electrode 25 is located above contact pin 20 and one or more panat packets 17 in electrical contact with terminal stud 15, a panat packet 17 representing a glass-material packet impregnated by thin metal layers, including a specific electrical resistance, and simultaneously ensuring that terminal stud 15 and contact pin 20 are fixed in the insulator opening. Insulator 10 is made of a ceramic material that is electrically insulating and shields the inside from influences of the environment and the engine compartment.

Contact pin 20 is made of a metal, preferably of an iron-based alloy, e.g., of an iron-nickel-cobalt (Fe-Ni-Co) alloy. However, the corrosion resistance of this alloy is low. Contact pin 20 is responsible for ensuring a spatial separation between center electrode 25 and panat packet(s) 17, since, due to their low temperature resistance (only to approx. 600° C.), the panat packet or the panat packets 17 cannot be exposed to the high temperatures at the tip of the insulator.

The spark plug is used to provide electrical energy for firing the fuel-air mixture in the combustion chamber of the internal combustion engine that is not shown. For this purpose, a high voltage is applied across terminal stud 15, panat 17, and contact pin 20 to center electrode 25, which then produces an arcing between center electrode 25 and ground electrode 30. As a result of the energy contained in the spark, the fuel-air mixture in the combustion chamber is ignited, thereby producing highly reactive gases by different reactions.

One difficulty in the operation of spark plugs is the corrosion of contact pin 20 caused by highly reactive gases leaking in along a small gap between the insulator and the center electrode. The gap between the center electrode and the insulator is created as a result of the insulator material and the electrode material having different thermal expansion coefficients and being exposed to significant fluctuations in temperature. According to the present invention, a layer of one or more metal aluminides is deposited on the surface of contact pin 20 to reduce corrosion. Preferably, the metal-aluminide layer has a thickness of up to 100 $\mu$m. However, it can also be advantageous for the metal-aluminide layer to have a greater thickness. As such, an increase in the required ignition voltage caused by corrosion can be effectively prevented. The energy demand is decreased, and the ignition reliability is improved.

Figure 2:
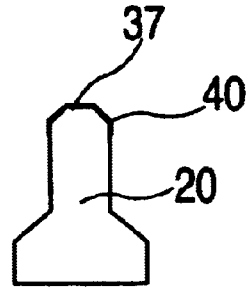
FIG. 2 shows a schematic longitudinal cross section of a contact pin according to the present invention.

FIG. 2 separately represents a longitudinal cross section of a contact pin according to the present invention. Contact pin 20 has a cylindrical form, the diameter of the end of contact pin 20 away from the combustion chamber being larger and conically offset from the region having the smaller diameter. The end of contact pin 20 on the side of the combustion chamber has a conically tapered tip that is flattened in the shape of a circle, thereby forming top surface 37 on the side of the combustion chamber. By depositing aluminum from the gas phase, a layer of one or more metal aluminides, which are illustrated by a wide line in FIG. 2, is formed on the surface of contact pin 20. Metal aluminides are intermetallic compounds of a metal and aluminum. During the preferable use of contact pin 20 made of an Fe-Ni-Co alloy, one or more corresponding Fe-Ni-Co aluminides are formed.

Layer thicknesses between 20 and 70 $\mu$m are preferable. Metal-aluminide layer 40 is formed at least on top surface 37 of contact pin 20 on the side of the combustion chamber and at least over a length of 1 mm measured from the top surface of the contact pin on the side of the combustion chamber.

The metal-aluminide layer significantly increases the corrosion resistance of contact pin 20. The protective effect of metal-aluminide layer 40 formed by the diffusion of the elemental aluminum into the contact pin is based on a closed, securely adhered, particularly thin $A1_2O_3$ layer that is formed on the exterior surface and protects the subjacent aluminide as well as the base material from corrosion due to its slow growth rate. Upon occurrence of a local destruction of the $A1_2O_3$ layer, e.g. as a result of peel off, a new $A1_2O_3$ layer forms due to the aluminum present in the aluminide. Thus, a self-repairing passivation of the coated surface of contact pin 20 is ensured.

Figure 3:
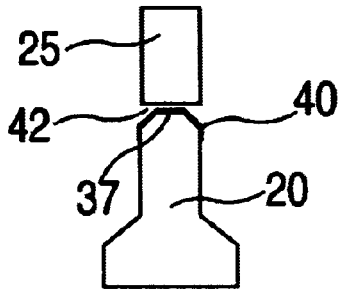
FIG. 3 shows a schematic longitudinal cross section of a contact pin according to the present invention and a precious-metal electrode.

In FIG. 3, another schematic longitudinal cross section of contact pin 20 according to the present invention and from FIG. 2 is shown, together with center electrode 25. Since top surface 37 on the combustion-chamber side of the contact pin is coated with metal-aluminide layer 40, one or more brittle precious-metal-aluminum compounds are formed under operating conditions, i.e., at temperatures of up to 1000° C., upon contact with precious-metal center electrode 25 at this top surface 37 of contact pin 20 that faces center electrode 25. Center electrode 25 is preferably made of platinum or a platinum alloy. Therefore, one or more brittle platinum-aluminum compounds form on this top surface 37 of the contact pin. Forming brittle compounds on top surface 37 of the contact pin is advantageous because linear deformations caused by different coefficients of thermal expansion of center electrode 25 and contact pin 20 that are too large and that occur in response to thermal cycling in the transitional region between center electrode 25 and contact pin 20 enable a gap to form. Such a gap is indicated by reference numeral 42 in FIG. 3. Gap 42 prevents center electrode 25 and contact pin 20 from being force-locked to one another. In this way, it can be ensured that the center electrode is stable in retaining its shape and location, thereby preventing an increase in the required ignition voltage. The gap formation is particularly defined when the thickness of the metal-aluminide layer from which the precious-metal-aluminum compound is formed has a thickness of more than 100 $\mu$m. There is a constant electrical contact between center electrode 25 and contact pin 20 when voltages occur normally in the spark plug.

Figure 4:
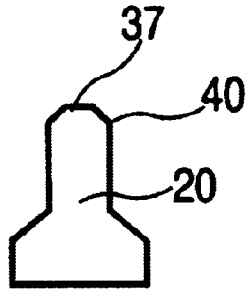
FIG. 4 shows a schematic longitudinal cross section of an additional exemplary embodiment of a contact pin according to the present invention.

An additional exemplary embodiment is represented in FIG. 4. Analogous to FIG. 2, the schematic longitudinal cross section of contact pin 20 is shown having an analogous form, the entire surface of contact pin 20 being coated by metal-aluminide layer 40. Analogous to FIG. 2, the wide line indicates metal-aluminide layer 40. Reference numeral 37, on the other hand, designates the top surface of the contact pin on the side of the combustion chamber.

A contact pin according to the present invention can be used in surface gap spark plugs, in air gap spark plugs, and in surface air gap spark plugs. In this context, a contact pin according to the present invention can also have a form other than the one represented in FIGS. 2 and 4. For example, the two diameters of the contact pin in FIGS. 2 and 4 can be selected arbitrarily. The length of the two regions and the length of the conical transition between the two regions are also not set. The length of the conically tapered tip of the contact pin on the side of the combustion chamber can also be selected at will. The diameter of top surface 37 on the side of the combustion chamber can also be arbitrarily selected. Accordingly, the contact pin can be optimally adapted to the dimensions of the spark plug and the conditions of the manufacture.

Figure 5:
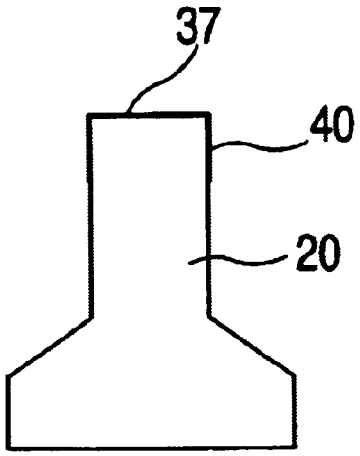
FIG. 5 shows a schematic longitudinal cross section of a further exemplary embodiment of the contact pin according to the present invention.
Figure 6:
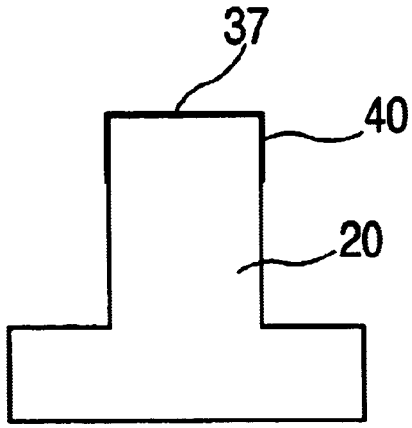
FIG. 6 shows a schematic longitudinal cross section of a further exemplary embodiment of the contact pin according to the present invention.
Figure 7:
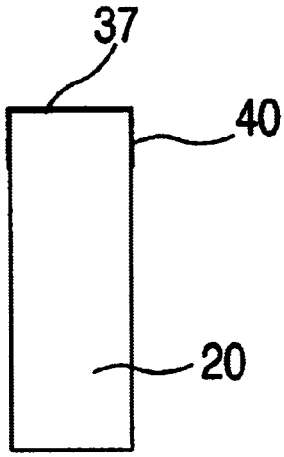
FIG. 7 shows a schematic longitudinal cross section of a further exemplary embodiment of the contact pin according to the present invention.

An additional exemplary embodiment is represented in FIG. 5. In comparison to the exemplary embodiment in FIG. 2, the longitudinal cross section of contact pin 20 does not have a conically tapered tip, but does have a top surface 37 whose diameter is not smaller than that of the cylindrical region on the side of the combustion chamber. Thus, top surface 37 on the side of the combustion chamber has the same diameter as the cylindrical region on the side of the combustion chamber. An exemplary embodiment as represented in FIG. 6 would also be conceivable. In this case, the transition between the cylindrical region on the side of the combustion chamber and the cylindrical region away from the combustion chamber and having the larger diameter is stepped. In en additional exemplary embodiment, there is no change in diameter along the contact pin, as represented in FIG. 7.

Figure 8:
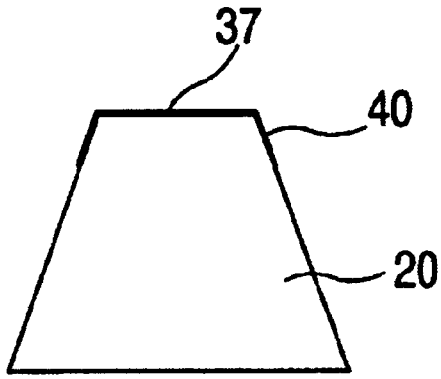
FIG. 8 shows a schematic longitudinal cross section of a further exemplary embodiment of the contact pin according to the present invention.
Figure 9:
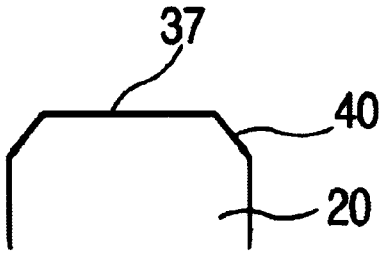
FIG. 9 shows a schematic longitudinal cross section of a tip of a contact pin on the side of the combustion chamber according to the present invention.

An embodiment of the contact pin shaped like a truncated cone is also possible, as shown in FIG. 8. The exemplary embodiments in FIGS. 6 through 8 can also have a design of the tip on the side of the combustion chamber, as described in FIG. 2 and as again separately represented in a longitudinal cross section in FIG. 9. Corresponding to FIG. 9, the tip of contact pin 20 on the side of the combustion chamber can taper in a conical manner and include a top surface on the side of the combustion chamber having a smaller diameter than the adjacent region.

The aluminum used for the aluminum-containing surface coating of contact pin 20, the metal aluminide, can be deposited using thermal spraying, physical vapor deposition (PVD), or chemical vapor deposition (CVD) from the gas phase. Preferably, the aluminum is deposited using a CVD process, aluminization in particular.

Aluminization is a process in which the surface layer of a workpiece is enriched with aluminum by a thermochemical treatment. In this context, the workpiece is embedded in a powder bed, for example, that is made up of a large proportion of $A1_2O_3$, a donator alloy containing aluminum, and an activator containing halogen. Elemental aluminum is deposited by a chemical reaction from a plurality of steps in a hydrogen-containing atmosphere at a pressure between 0.01 and 10 Mpa and at temperatures from 900° C. to 1100° C. over a time of up to 10 hours. A large number of contact pins can be embedded in the powder bed, thereby facilitating inexpensive aluminization. However, the aluminization can also be performed without a powder bed, by producing a transportable, gaseous aluminum compound, an aluminum halogenide, at a different location with respect to the location at which the contact pin is coated and by transporting the compound to the coating location by a flow containing hydrogen gas. The transportable aluminum compound is formed from an aluminum-containing donator alloy and a halogen-containing activator.

In this context, it is possible to separate the location at which the transportable aluminum compound is created and the location at which the contact pin is coated in such a way that they are arranged in different vessels. However, they can also be in the same vessel.

Before installing the contact pin, an additional oxidation step of the coated contact pin can be performed. This pre-oxidation results in the formation of the above-described passivating $A1_2O_3$ layer, even before the contact pin is installed. The oxidation occurs at temperatures between 500° C. and 1200° C. over a time interval of up to 100 hours in an oxygen-containing atmosphere.

Figure 10:
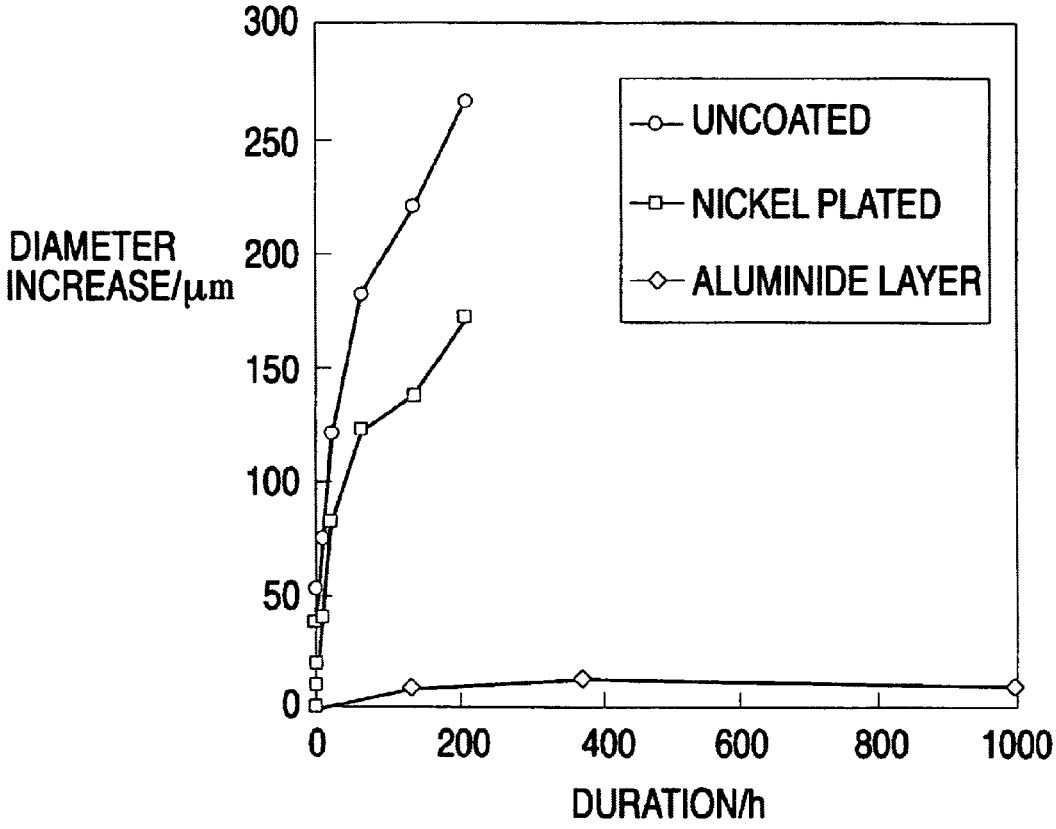
FIG. 10 shows a diagram in which the increase in diameter of an uncoated, a nickelized, and an aluminized contact pin according to the present invention is plotted over time during ageing at 900° C. in the presence of air.

Using a diagram, FIG. 10 shows the above-described effect of metal-aluminide layer 40. The diagram shows the increase in diameter of a contact pin when the contact pin is exposed to a temperature of 900° C. in the presence of air. The increase in diameter of the tested contact pin is recorded in $\mu$m over the duration of the ageing in hours. In this context, the round symbols indicate the measured values for an uncoated Fe-Ni-Co contact pin, the squares indicate the measured values for an Fe-Ni-Co contact pin provided with 20–30 $\mu$m thick nickel layer, and the rhombuses indicate an Fe-Ni-Co contact pin produced by aluminization and provided with a 25–60 $\mu$m thick Fe-Ni-Co aluminide layer. In each case, the coating is applied to the entire surface of the contact pin. In the case of the uncoated and the nickel-plated contact pin, a considerable increase in diameter can be clearly seen, while the increase in diameter for the aluminized contact pin is minimal. Furthermore, in the case of the aluminized contact pin, no additional increase in diameter is observed after approx. 300 hours. In each case, the increase in diameter is caused by corrosion of the contact pin. In the case of the aluminized contact pin, the insignificant increase in diameter is a result of the formation of the $A1_2O_3$ layer.

A reduction in corrosion and a stability of shape and location of the center electrode can be observed in spark plugs having a contact pin according to the present invention.

What is claimed is:

1. A spark plug, comprising:

an insulator including a cylindrical opening;

a precious-metal electrode arranged in the cylindrical opening and extending into a combustion chamber of an internal combustion engine during a normal operation;

a metallic contact pin arranged in the cylindrical opening and arranged adjacently to an end of the precious-metal electrode away from the combustion chamber, wherein the metallic contact pin includes an electrical contact; and a layer including at least one metal aluminide arranged on a surface of the metallic contact pin;

wherein, in response to a thermal cycling, a gap forms between the metallic contact pin and the precious-metal electrode.

2. The spark plug according to claim 1, wherein:

the layer including the at least one metal aluminide covers an entirety o of the surface the metallic contact pin.

3. The spark plug according to claim 1, wherein:

the metallic contact pin includes an Fe-Ni-Co alloy, and the at least one metal aluminide includes at least one of a Fe aluminide, a Ni aluminide, and a Co aluminide.

4. The spark plug according to claim 1, wherein:

at least one precious-metal-aluminum compound forms in a transitional region between the metallic contact pin and the precious-metal electrode.

5. The spark plug according to claim 4, wherein:

at least one platinum-aluminum compound forms in the transitional region.

6. The spark plug according to claim 1, wherein:

the metallic contact pin is coated with aluminum to form an aluminum coating in accordance with one of a thermal spraying operation, a physical deposition operation from a gas phase, and a chemical deposition operation from the gas phase.

7. The spark plug according to claim 6, wherein:

the aluminum coating corresponds to an aluminum enrichment in a surface layer of the metallic contact pin, using a thermochemical treatment.

8. The spark plug according to claim 7, wherein:

the thermochemical treatment corresponds to an aluminization.

9. The spark plug according to claim 8, wherein:

the aluminization occurs in a powder bed.

10. The spark plug according to claim 6, wherein:

the coated metallic contact pin undergoes an oxidation operation before being installed in the spark plug.

11. The spark plug according to claim 1, wherein:

the metallic contact pin includes a cylindrical shape.

12. The spark plug according to claim 1, wherein:

the metallic contact pin includes a cylindrical shape, the metallic contact pin includes two regions that merge conically and include different diameters, and one of the two regions having a smaller one of the different diameters forms an end of the metallic contact pin on a side of the combustion chamber.

13. The spark plug according to claim 1, wherein:

the metallic contact pin includes a cylindrical shape, the metallic contact pin includes two regions that have different diameters and are offset from one another in a stepped manner, and one of the two regions having a smaller one of the different diameters forms an end of the metallic contact pin on a side of the combustion chamber.

14. A spark plug, comprising:

an insulator including a cylindrical opening;

a precious-metal electrode arranged in the cylindrical opening and extending into a combustion chamber of an internal combustion engine during a normal operation;

a metallic contact pin arranged in the cylindrical opening and arranged adjacently to an end of the precious-metal electrode away from the combustion chamber, wherein the metallic contact pin has a cylindrical shape and includes an electrical contact; and a layer including at least one metal aluminide arranged on a surface of the metallic contact pin;

wherein the metallic contact pin includes a conically tapered tip, and an end of the conically tapered tip on a side of the combustion chamber forms a circular top surface that includes a smaller diameter than that of a cylindrical region on the side of the combustion chamber.

15. The spark plug according to claim 1, wherein:

the metallic contact pin is shaped as a truncated cone.

* * * * *